US006755566B2

(12) United States Patent
Damasko

(10) Patent No.: US 6,755,566 B2
(45) Date of Patent: Jun. 29, 2004

(54) CLOCKWORK

(76) Inventor: Konrad Damasko, Unterheising 17c, 93092 Barbing (DE)

( * ) Notice: Subject to any disclaimer, the term of this patent is extended or adjusted under 35 U.S.C. 154(b) by 251 days.

(21) Appl. No.: 10/068,985

(22) Filed: Feb. 11, 2002

(65) Prior Publication Data

US 2002/0114225 A1 Aug. 22, 2002

(30) Foreign Application Priority Data

| | | |
|---|---|---|
| Feb. 15, 2001 | (DE) | 101 07 499 |
| Mar. 8, 2001 | (DE) | 101 11 150 |
| Apr. 3, 2001 | (DE) | 101 16 511 |
| Jun. 15, 2001 | (DE) | 101 28 648 |
| Jul. 3, 2001 | (DE) | 101 32 108 |

(51) Int. Cl.[7] ..... G04B 15/00; G04B 29/00
(52) U.S. Cl. ..... 368/127; 3687/324; 3687/325
(58) Field of Search ..... 368/127–133, 368/322–326; 387/297, 907, 907.1

(56) References Cited

U.S. PATENT DOCUMENTS

| | | | | |
|---|---|---|---|---|
| 2,027,788 A | * | 1/1936 | Ridgway et al. | 384/297 |
| 2,675,668 A | * | 4/1954 | Morf | 368/324 |
| 3,747,325 A | * | 7/1973 | Schnieider | 368/325 |

FOREIGN PATENT DOCUMENTS

| | | | |
|---|---|---|---|
| CH | 272881 | * | 1/1951 |
| CH | 346173 | * | 4/1960 |
| CH | 347777 | * | 7/1960 |
| CH | 529373 | * | 6/1972 |
| CH | 612308 | * | 7/1979 |
| DE | 195 19 714 A1 | | 11/1996 |
| EP | 0 175 980 | | 9/1985 |

OTHER PUBLICATIONS

"Alternative en lubrification: Les carbones amorphes", D. Lauper, F. Maier, Congres European de Chronometric; CEC 2000—Genene Sep. 28–19, 2000, pp. 1–3 (with translation).

* cited by examiner

*Primary Examiner*—Vit W. Miska
(74) *Attorney, Agent, or Firm*—Hoffman, Wasson & Gitler P.C.

(57) ABSTRACT

In the clockwork, according to the present invention, the bearing journals of the balance staff, and also of the pallet staff, have a larger diameter than in known clockworks, since a DLC coating of these bearing journals and the corresponding surfaces of the bearings provides for very low friction, which enables an increase in the bearing journal diameter without diminishing the function and accuracy. The enlargement of the bearing journal diameter results in improved shock-resistance in addition to making the elements provided for shock resistance in conventional clockworks (spring-mounted bearings for the balance staff) partially, or wholly, unnecessary.

31 Claims, 4 Drawing Sheets

CLOCKWORK

BACKGROUND OF THE INVENTION

The present invention relates to a mechanical clockwork preferably, but not exclusively, to a clockwork for pocket watches and wrist watches.

Numerous embodiments of clockworks are known. Mechanical clockworks have become increasingly popular in the past few years, whereby synthetic rubies are used for the clockworks in pocket watches, and wrist watches, at locations where a low friction coefficient is needed in order to prevent abrasion, i.e. especially on the bearings of the staffs and in areas of escapement, i.e. in areas of the anchor cooperating with the escape wheel and in areas of the oscillation system (balance wheel) cooperating with the anchor, in particular as bearings for the staff, as anchor plates or anchor jewels as well as impulse pins on the balance staff. This entails additional assembly steps and additional expense.

Furthermore, it is necessary with mechanical clockworks that they be reconditioned at regular intervals in order to restore the accuracy, i.e. especially residue from oil and friction must be washed out and the bearings re-oiled, which also requires at least partial disassembly, of the clockwork, and subsequent re-regulation of the rate.

The object of the present invention is to provide a clockwork that is characterized by high accuracy and in which the customary maintenance heretofore required is practically unnecessary, or necessary only at very large intervals.

SUMMARY OF THE INVENTION

"DLC coating" as understood in the present invention refers to Diamond-Like-Carbon hard material coating, which, based on the element carbon forms a diamond-like layer with a high micro-hardness and with an extremely low friction coefficient. The thickness of this coating is, for example, between 2 and 4 m$\mu$. The hardness of such a DLC coating is on the order of 2500 HV or higher. It is manufactured by means of plasma-supported chemical gas phase precipitation, for example, at a coating temperature of approximately 150–220° C. During precipitation of the coating, silicon and oxygen atoms can also be added, which provides even further reduction of friction. Such a DLC coating and its manufacture is described, for in example, in WO 98/59089.

"Functional elements" as understood in the present invention are elements of the oscillation system (balance wheel) and the elements of the escapement, in particular, the anchor and the escape wheel. "Further functional elements", as understood in the present invention, are also the wheels of the train, the journals and bearings of the clockwork.

As far as the DLC-coated functional elements, plates, or plate elements, made of brass. It is expedient to first apply a thin layer made of a harder metal, for example a chrome layer, to the respective surface in order to achieve better adhesion of the DLC layer.

Functional elements, plates or plate elements, etc. made of steel, in particular stainless steel, are preferably heat-treated, e.g. by means of vacuum hardening or plasma nitriding, before application of the DLC coating.

The present invention makes the use of the heretofore customary press-fit bearing of synthetic ruby unnecessary. The bearings are instead, for example, integrated directly in the plate and the plate elements (bridges) and consist of bearing bores, or preferably of inserted metal bearings, that are DLC-coated at least on their bearing surfaces.

Furthermore, preferably, gear teeth, and pinions together with bearing journals, in the present invention, are DLC-coated, resulting in a significant reduction of friction in the entire train, as compared with conventional clockworks.

In the clockwork, according to the present invention, the bearing journals of the balance staff, and also of the pallet staff, have a larger diameter than in known clockworks, since a DLC coating of these bearing journals and the corresponding surfaces of the bearings provides for very low friction, which enables an increase in the bearing journal diameter without diminishing the function and accuracy. The enlargement of the bearing journal diameter results in improved shock-resistance in addition to making the elements provided for shock resistance in conventional clockworks (spring-mounted bearings for the balance staff) partially, or wholly, unnecessary A further advantage of a mechanical clockwork is that the anchor pallets, or anchor pins, etc., made of synthetic stones (rubies) are not necessary. This makes the processing steps required for the manufacture of these pallets, stones, etc., and their assembly, unnecessary.

The essential advantages of the present invention can therefore be summarized as follows:

- Synthetic press-fit bearings, pallets, anchor jewels, impulse pins etc. made of ruby are no longer necessary.
- The clockwork requires no lubrication, so that there is no danger of hardening of oils and the resulting loss of precision.
- Reduced friction in the entire system achieves absolutely stable accuracy over an extended period.
- Maintenance of the clockwork is practically no longer required, or only after a number of years, for example, after five years.
- The high surface hardness prevents mechanical wear due to friction. This increases the long-term precision, as well as the length of the maintenance-free period.
- Simplification of the structural design of the clockwork results in a significant reduction in manufacturing costs.
- The DLC coating provides protection against corrosion and therefore prevents loss of precision as well as detriments to the overall condition of the clockwork even if penetrated by moisture.

In a preferred embodiment of the present invention, the cooperating surfaces, for example, the bearing surfaces and/or the cooperating surfaces in the area of the escapement, for example in the area of the anchor pallet, are designed in such a way that all of these surfaces possess the DLC coating and the other element of the cooperating surfaces is made of silicon carbide (SiC) . In this way, for example, the bearings of the staffs of the clockwork consist of jewels of silicon carbide, while the surfaces of the staffs cooperating with these jewels possess the DLC coating. In a similar manner, the anchor pallets, for example, are made of silicon carbide, while the surfaces of the anchor or escape wheel 1 cooperating with these pallets are DLC coated. It has been proven that the combination of DLC coating and silicon carbide results in extremely low friction coefficients on the order of 0.05–0.02, very surprisingly, however, since, for example, the combination of silicon carbide and silicon carbide results in a significantly higher friction coefficient, so that silicon carbide is generally to be regarded as unsuitable as a jewel in mechanical clockworks.

BRIEF DESCRIPTION OF THE DRAWINGS

Further advantages and special features of the present invention will become obvious in the following description of a possible embodiment of the clockwork according to the present invention. The invention is described in more detail below in conjunction with the drawing of a representative embodiment.

DETAILED DESCRIPTION OF THE INVENTION

Figure 1:
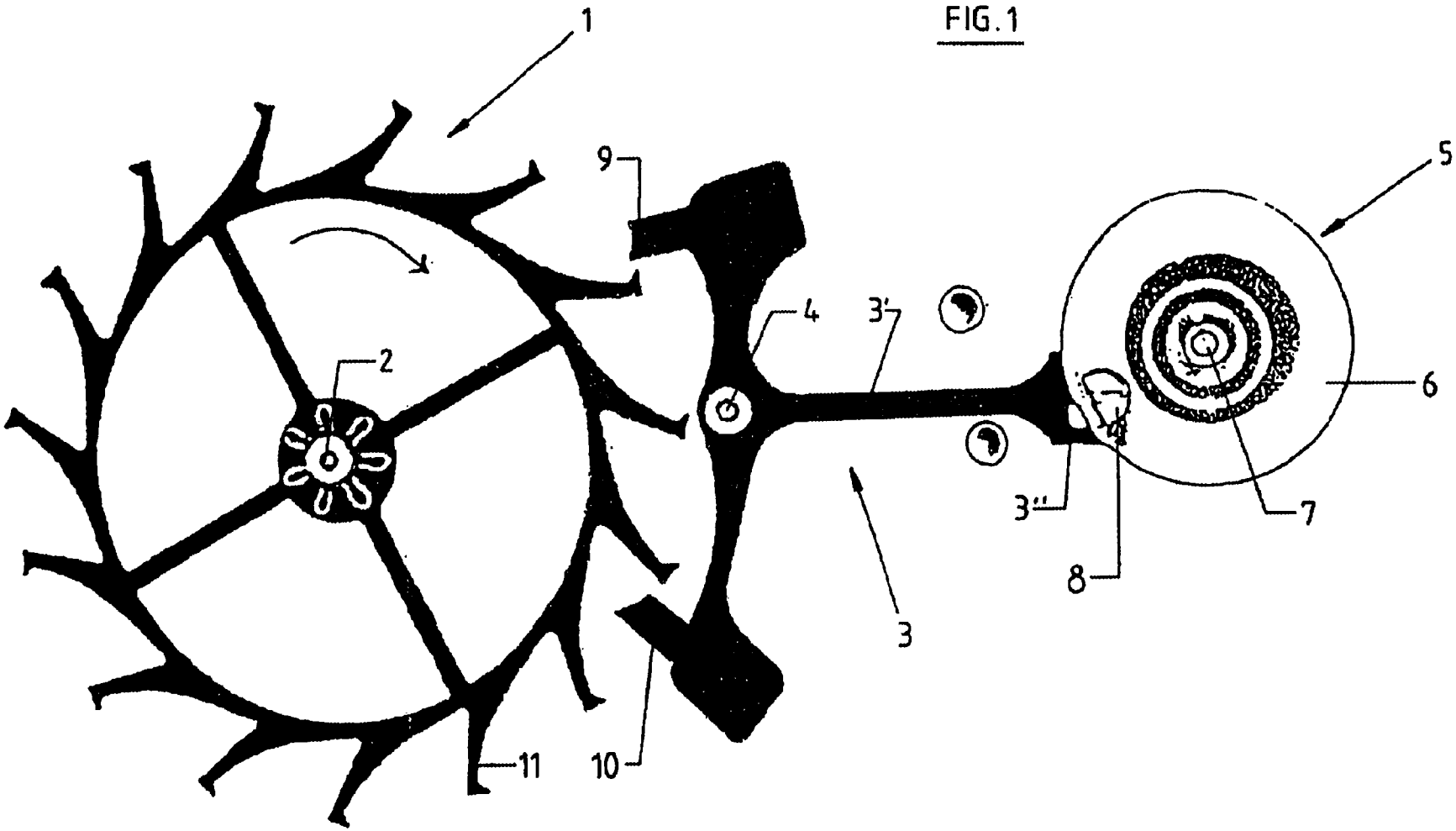
FIG. 1 shows a simplified view of the anchor escapement of a mechanical pocket watch or wrist watch according to the present invention.

FIG. 1 shows as a possible embodiment, the anchor escapement of a mechanical clockwork for a pocket watch or wrist watch. This escapement contains the anchor, or escape wheel 1, linked to the remaining clockwork or train. The escape wheel can move by means of its bearing journal 2, in the plate of the clockwork not depicted in FIG. 1, and linked to the remaining, likewise not depicted, functional elements of the clockwork, and of the anchor 3, which also pivots on its bearing journal 4, that can move in the plate, in particular at an oscillation frequency determined by the balance wheel 5. The yoke end 3" located on the anchor arm 3' of the anchor 3 cooperates with an impulse pin 8 located on a discharging roller 6 of the balance staff 7.

Furthermore, the anchor 3 possesses two pallets cooperating with the anchor wheel 1 or with the anchor wheel teeth 11 there, namely the entry pallet 9 and the exit pallet 10. The special feature of this anchor escapement includes, among other things, the fact that the anchor 3 is manufactured as one piece of metal, preferably hardened stainless steel, together with the corresponding pallets 9 and 10, and is DLC coated at least on the surfaces of the pallets 9 and 10 cooperating with the teeth 11, and that the escape wheel 1 is DLC coated at least on the teeth 11 cooperating with the pallets 9 and 10. Furthermore, the anchor 3 is DLC coated at least on its yoke end 3" cooperating with the impulse pin 8 or discharging roller 6. The impulse pin made of metal, for example of steel, also possesses a DLC coating.

In a preferred embodiment of the present invention, at least the bearing journals 3 and 4 and the balance staff 7 are DLC coated, whereby the corresponding bearings in the plate manufactured from steel, for example, or another suitable metal a are formed by simple bore holes in the simplest design and then at least the areas of these bores holes forming the bearing surfaces being DLC coated.

This coating results in an extremely high surface hardness of approximately 2500 HV, so that even without lubrication there is no perceptible wear. In particular, with respect to the anchor escapement, the customary synthetic rubies heretofore used for the pallets 9 and 10 and for the impulse pin a there and requiring an additional assembly step with additional expense, are no longer necessary. Instead, the anchor 3 can be manufactured of metal, or steel, as one piece with the pallets 7. Furthermore, it is possible to manufacture the impulse pin 8 of metal in an especially easy manner.

Figure 2:
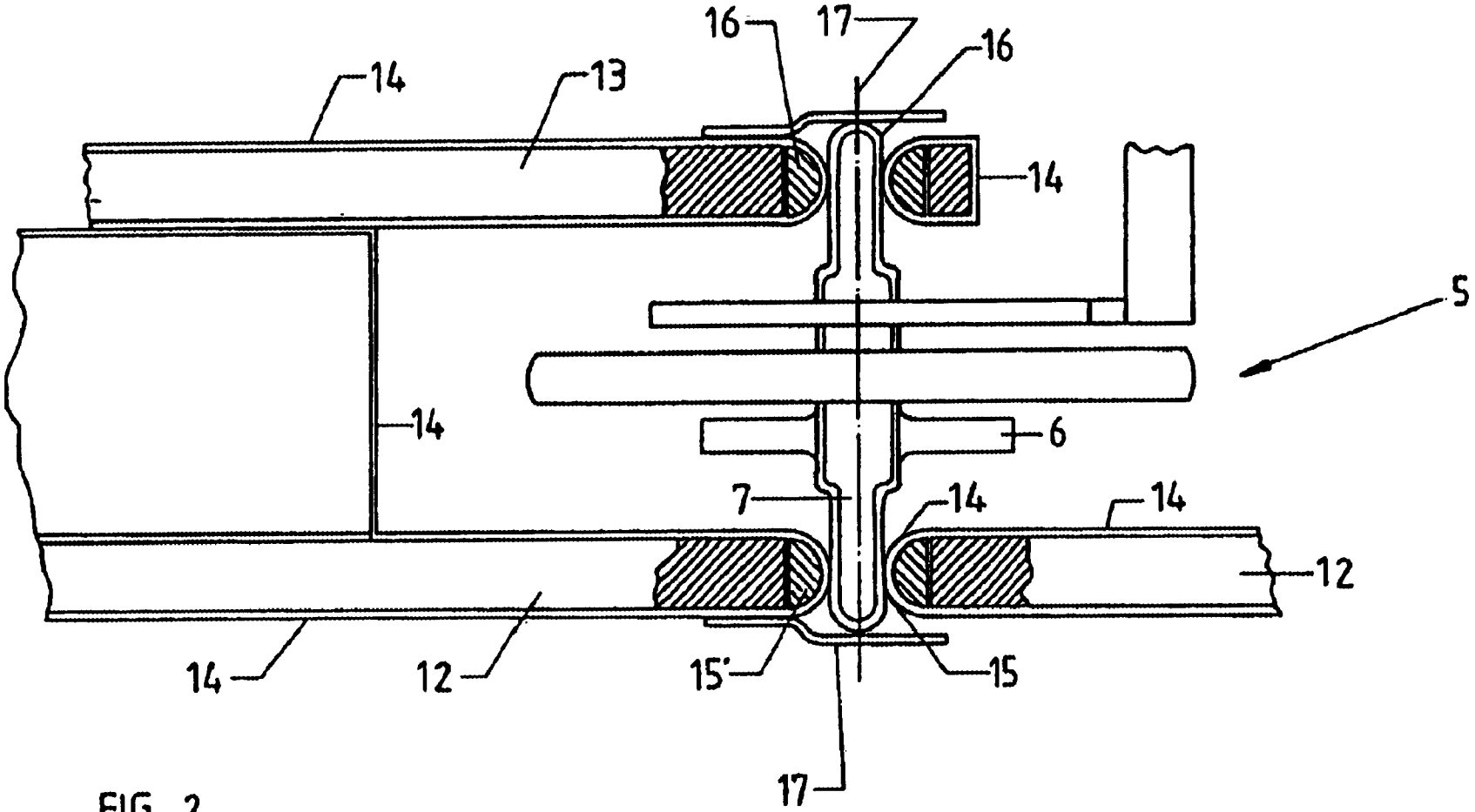
FIG. 2 shows a simplified schematic partial view in cross-section of the movement plate and a bridge located on this plate, in particular in the area of the balance wheel.

FIG. 2 shows a simplified view of the balance wheel 5, with the balance staff 7, which can move by means of bearings on the movement plate 12, and a further plate 13 (bridge). As FIG. 2 shows, the movement plate 12, the bridge 13 and also the balance staff 7, are provided with the DLC coating 14 over the entire surface, also extending into the bearing bore holes 15 and 16, which are provided in the plate 12 and bridge 13 for the balance staff 7. Since both the staff 7, and the bearing surfaces, formed by the bore holes 15 and 16, are DLC coated, this results in an extremely low friction coefficient, so that the balance journal or balance staff 7 can be larger than in known embodiments. The balance staff can have a diameter of 0.2 mm, instead of the heretofore customary 0.1 mm. In any event, this results in improved shock resistance, so that the heretofore customary shock resistance protection may be made wholly unnecessary by the spring-mounted bearings of the balance staff 7. Preferably all other staffs and journals and the corresponding bearings of the clockwork are also DLC coated, making the customary jewels or rubies unnecessary, thus enabling a simplified manufacturing process while simultaneously decreasing the friction in the entire system. This significantly improves the accuracy, without lubrication or subsequent lubrication of the bearings.

Preferably, all of the gear teeth are provided with the DLC coating, at least on their teeth, or tooth flanks, which helps to decrease friction, increase the accuracy over an extended period, and prevent wear.

The DLC coating also has the advantage that it provides very effective protection against corrosion, so that even corrosion on the plate, on staffs, on gear teeth and on other functional elements of the clockwork are effectively prevented.

In FIG. 2, there are depicted, two springs 17, that serve as protection against shock. These springs 17 also are provided with the DLC coating at least on their side facing the staff 7.

As far as brass is used as the base material for the elements, described above, for example, for the plate 12 and/or the bridge 13, or for gear teeth, these elements are to be provided with a coating made of a harder metal, for example, chrome, before the DLC coating is applied. If functional elements are made of steel, for example, stainless steel, then they are preferably heat treated, for example, by means of vacuum hardening, and/or plasma nitriding, before application of the DLC coating.

It has been assumed above that the bore holes 15 and 16 are located directly in the plate 12, or bridge 13. In practice, however, it will be expedient to provide for these bearing bore holes in bearing bushings 15' and 16', which are manufactured from stainless steel or hardenable steel, preferably from steel suitable for plasma nitriding (e.g. stainless steel 4301 in accordance with DIN 1.4301) by means of metal cutting and provided with the DLC coating 14 after hardening, especially on the bearing surfaces, and pressed into the bridge 13, and into the plate 12. The bearing bushings 15' and 16' can also be made of hard metal.

The present invention was described above based on a representative embodiment. It will be understood that numerous modifications and alterations are possible, without abandoning the underlying inventive concept on which the present invention is based. For example, it is also possible to at least partially retain the customary bearings made of synthetic rubies especially in mechanical clocks and to provide the surfaces cooperating with these bearings, i.e. the surfaces of the bearing journals, with the DLC coating.

Furthermore, it is also possible in particular to use jewels of silicon carbide for the staffs 2 and 7, while the staffs themselves possess the DLC coating at least on their surfaces cooperating with the jewels. It has been proven that the DLC coating, in combination with silicon carbide, leads to extremely low friction coefficients, especially in dry air, such as can be assumed in a closed clockwork, for example a friction coefficient on the order of only 0.02, in particular with a high resistance to wear for both the jewels and the staffs on their surfaces cooperating with the jewels.

Furthermore, it is possible to manufacture the entry and exit pallets 9 and 10 also of silicon carbide, whereby the anchor or escape wheel possesses the DLC coating at least on the anchor wheel teeth cooperating with these pallets.

Figure 3:
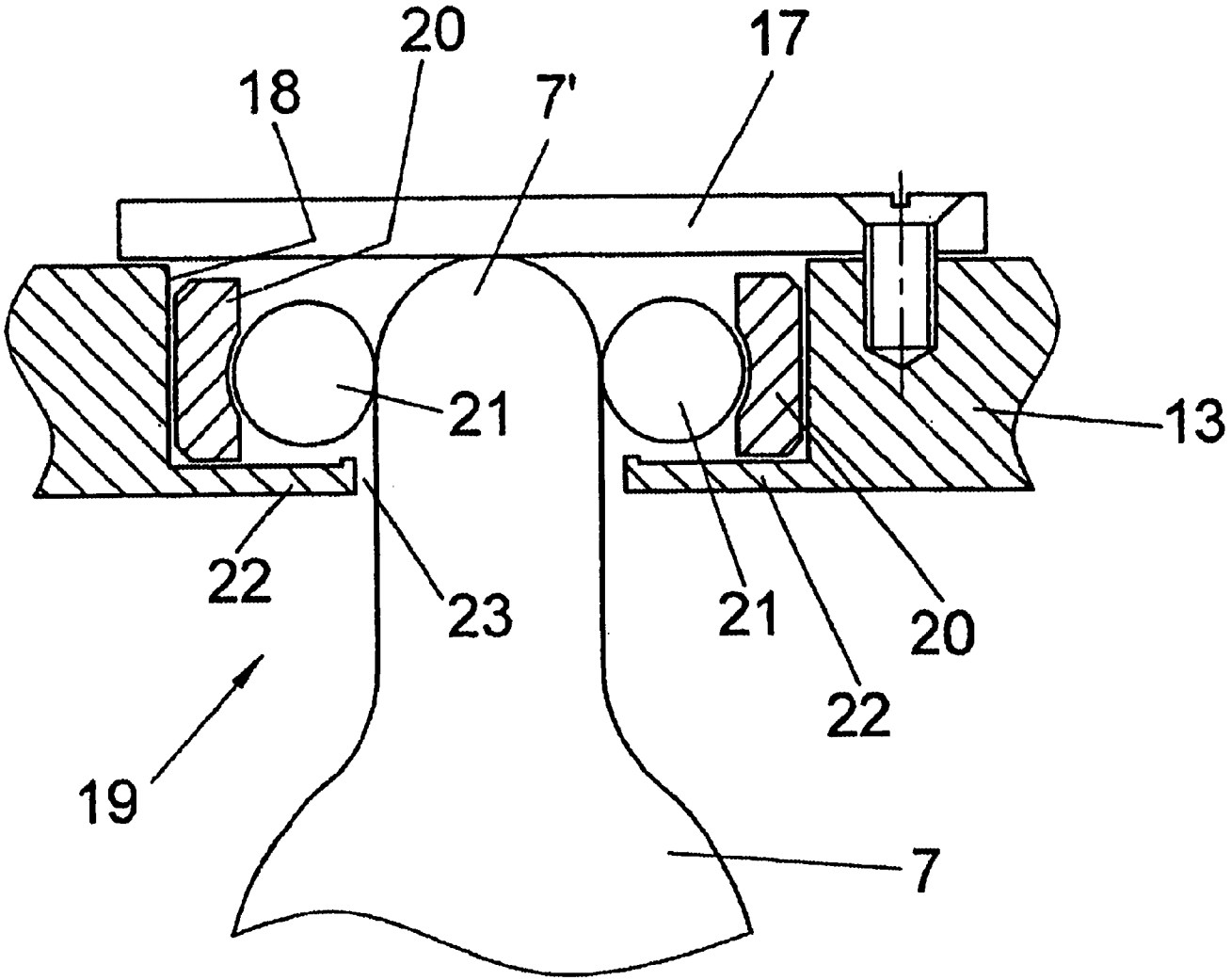
FIGS. 3 and 4 show an enlarged partial view, as a further possible embodiment of the present invention, of the bearings of the balance staff or balance journal.

FIG. 3 shows a partial enlarged view of the bearings of the balance staff 7 or the upper end 7' of this staff with a reduced diameter. The lower end of the staff 7 can also move by means of bearings in the same manner as shown in this drawing, in the movement plate, not shown in this drawing.

The staff 7 is made of hardened stainless steel (for example, by means of plasma nitriding) and in the depicted embodiment DLC coated at least in the area of its section 7' or provided with another coating that ensures a hard surface with a low friction coefficient for the section 71.

The staff 7 can move with its journal end 7' in the bridge 13. For this purpose, there is a special bearing 19 in a recess there with a spherical form and consisting of the bearing ring 20 and the spherical bearing elements 21, which cooperate directly with the section 7' of the staff 7. The bearing ring 20 is held in a suitable manner, for example, by press fitting, in the recess 18. On the bottom side facing the middle of the staff 7 the bridge 13 forms a ring-shaped stay 22 with an opening 23, through which the journal end 7' is inserted and which possesses a diameter that is somewhat larger then the diameter of this journal end 7', but smaller than the diameter of the recess 18.

While the plate, or the bridge 13, is manufactured from brass, for example, the bearing ring 20 is made of hardened stainless steel and is coated in a suitable manner, for example DLC coated, at least on the surfaces cooperating with the bearing elements 21.

The bearing elements 21 are made of silicon carbide, synthetic ruby, or of a ceramic material, for example $Al_2O_3$ ceramic. The diameter of the bearing elements is on the order of the journal end 7', i.e. in the depicted embodiment, the diameter of the bearing elements is approximately 0.3 mm and the outer diameter of the journal end 7' is approximately 0.5 mm.

On the top side of the bridge 13, facing away from the movement plate, the bearing 19 is enclosed by the spring 17, which, for example, is made of hardened stainless steel and is DLC coated, or is made of silicon carbide, or synthetic ruby. The journal end 71 bears against the spring 17.

Another material, such as silicon carbide, synthetic ruby or $Al_2O_3$ can also be used for the material and/or coating of the spring.

The bearing 19 shown in FIG. 3 is characterized by a construction that can be realized easily and economically. In particular, the bearing elements 21 are made of silicon carbide, of ceramic, or of synthetic ruby, and can easily be manufactured in the required spherical form. Despite the relatively large diameter of the bearing elements 21, in comparison with the bearing journal end 7', the bearing 19 can be assembled without difficulty.

Figure 4:
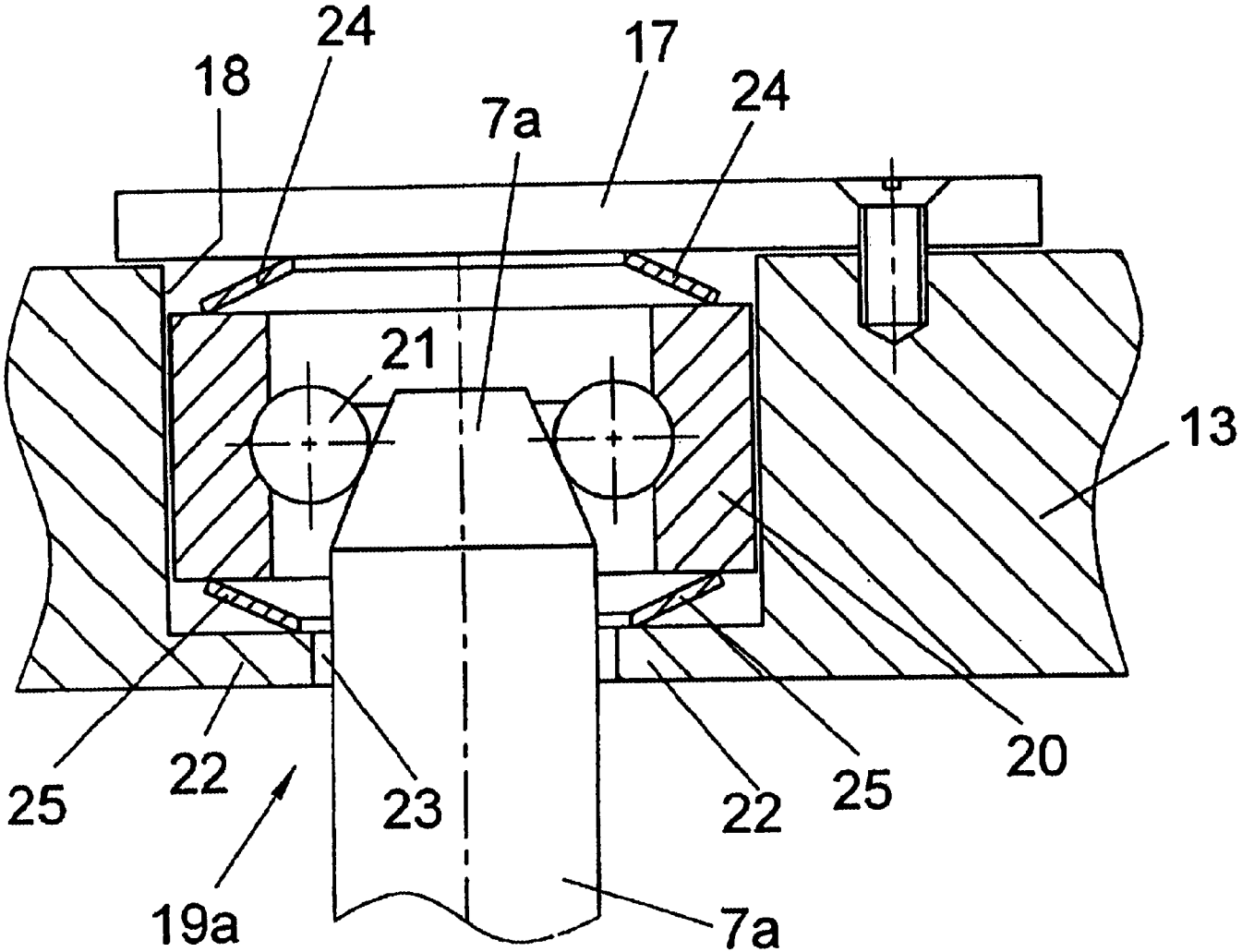

FIG. 4 shows as a further possible embodiment, a bearing 19a, which differs from the bearing 19, in that the bearing ring 20 is floating, i.e. axially moveable in the direction of the ring axis in the opening 18 and is held axially in the opening 18 by two spring elements, in the depicted embodiment, including the plate springs 24 and 25. The upper spring element 24 in FIG. 4 bears against the spring 17, or a corresponding plate, provided for on the bridge 13, and the lower spring element 25, bears on the top side of the stay 22, facing the plate, or the spring 17.

The staff 7*a* is designed with a journal end 7*a'* corresponding to the journal end 7', which tapers in a truncated manner toward the free end, in particular with a taper angle of 40°. The two spring elements 24 and 25 are designed in such a way that the force of the spring element 24 is somewhat greater than the force of the spring element 25, so that the spherical bearing elements 21 bear with a low force against the spherical sleeve surface of the journal end 7*a'* of the balance staff 7*a*.

In the bearing 19*a*, depicted in FIG. 4, plate springs arranged on the same axis as the staff 7*a* and are provided for as the spring elements 24 and 25. Instead of these plate springs, other suitable spring elements can also be used, for example curved washers. The staff 7*a* is made of hardened stainless steel and is DLC coated at least on the ends 7*a'*.

Of course, it is also possible to provide further parts or functional elements of the clockwork with the DLC coating, for example, inner surfaces of a spring barrel, in particular, at the location where the spring bears with its end on the inner surface of the spring barrel and is moved together with the rotating spring barrel during winding of the clockwork or the spring. Due to the DLC coating, the heretofore required oiling is no longer necessary.

LIST OF REFERENCE SYMBOLS

1 anchor or escape wheel
2 pallet staff
3 anchor
3' anchor arm
3" yoke end
4 anchor bearing journal
5 balance wheel
6 discharging roller
7 balance staff or pivot
8 impulse pin or pivot
9 entry pallet
10 exit pallet
11 anchor wheel gear
12 movement plate
13 bridge
14 DLC layer
15, 16 bearing bore hole
15', 16' hard alloy bearing
17 spring
18 recess
19 bearing
20 bearing ring
20', 20" bearing ring section
21 spherical bearing element
22 bore hole

What is claimed is:

1. A mechanical clockwork for pocket watches and wrist watches, with a mechanical escapement that cooperates with a mechanical oscillating system comprising at least one escape wheel, and one anchor, said anchor having areas, cooperating with said at least one escape wheel, said anchor and said areas, or said escape wheel and areas having a DLC coating.

2. The mechanical clockwork according to claim 1, wherein said anchor and said areas of the anchor are manufactured as one piece of metal.

3. The mechanical clockwork according to claim 1, wherein said at least one escape wheel is provided with said DLC coating at least on an escape wheel gear surface cooperating with the anchor.

4. The mechanical clockwork according to claim 1, wherein the areas cooperating with the at least one escape wheel are anchor pallets or anchor pins.

5. The mechanical clockwork according to claim 1, further comprising on a surface of the anchor cooperating with a pivot on a balance wheel, a pin, which function as an impulse pin, provided with the DLC coating.

6. The mechanical clockwork according to claim 5, wherein a staff of the balance wheel serving as an oscillating system is provided with the DLC coating at least in its areas with bearings in a plate.

7. The mechanical clockwork according to claim 6, wherein the bearings for the balance staff comprise bearing bore holes that are provided with the DLC coating at least in the area of the bearing surfaces.

8. The mechanical clockwork according to claim 7, wherein the bearing bore holes are located in bearing bushes made from stainless steel or heat treatable steel, and are provided with the DLC coating.

9. The mechanical clockwork according to claim 1, wherein that at least part of gears of the clockwork are provided with the DLC coating at least in the area of the teeth or tooth flanks.

10. The mechanical clockwork according to claim 1, wherein the functional elements of the clockwork are all provided with the DLC coating over their entire surface.

11. The mechanical clockwork according to claim 1, further comprising plates and plate elements for bearing the functional elements, and at least one plate or the plate elements are provided with a DLC coating on bearings for the functional elements of the surfaces forming the clockwork.

12. The mechanical clockwork according to claim 10, wherein the at least one plate and the plate elements are provided with the DLC coating on their entire surface.

13. The mechanical clockwork according to claim 10, wherein the DLC coating extends into bore holes serving as bearings and completely covers inner surfaces of the bore holes.

14. The mechanical clockwork according to claim 1, wherein the functional elements are made of brass and have an intermediate layer made of hard metal under the DLC coating.

15. The mechanical clockwork according to claim 1, wherein the functional elements are made of steel and are heat treated by means of vacuum hardening or plasma nitriding before the DLC coating.

16. The mechanical clockwork according to claim 1, wherein at least one bearing of the clockwork consists of a jewel and a surface cooperating with this one bearing possesses the DLC coating.

17. The mechanical clockwork according to claim 1, further comprising at least two cooperating and sliding surfaces of the clockwork, wherein one surface is made of silicon carbide and the second surface possesses the DLC coating.

18. The mechanical clockwork according to claim 1, wherein at least one bearing of the clockwork is made of silicon carbide and at least an opposite surface cooperating with the one bearing, possesses the DLC coating.

19. The mechanical clockwork according to claim 1, wherein the functional element cooperating with an anchor or escape wheel of the clockwork are made of silicon carbide, and an opposite surface of the escape wheel possesses the DLC coating.

20. The mechanical clockwork according to claim 1, further comprising an impulse pin or pivot of one escapement of the clockwork made of silicon carbide and an opposite surface cooperating with the impulse pin possesses the DLC coating.

21. The mechanical clockwork according to claim 1, further comprising a spring barrel with the DLC coating on at least a part of an inner surface.

22. A clockwork for pocket watches or wrist watches comprising a balance staff with bearings on both ends that can move in a plate or on a plate element, wherein the balance staff has at least one end that can move in a plate or on a plate element, wherein the balance staff has at least one end that can move in a bearing possessing a bearing ring and bearing elements within the bearing ring and enclosing the balance staff, and wherein the bearing elements are made of silicon carbide, a ceramic materials or a synthetic ruby.

23. The clockwork according to claim 22, wherein the bearing elements are spherical.

24. The clockwork according to claim 22, wherein the balance staff can move in the bearing with one journal end having a reduced cross-section.

25. The clockwork according to claim 24, wherein a diameter of the bearing elements is on the order of the diameter of the journal end of the balance staff.

26. The clockwork according to claim 22, wherein the balance staff has a DLC coating, at least in an area that can move in the bearing.

27. The clockwork according to claim 22, wherein the bearing ring and the bearing elements arranged in the ring are covered by a spring on the side of the bearing facing away from the balance staff, against which the balance staff bears with its free end.

28. The clockwork according to claim 27, wherein the spring is hardened and has a DLC coating or a ceramic coating at least on it surface forming a bearing for the balance staff.

29. The clockwork according to claim 23, wherein the bearing ring is axially pre-tensioned by at least one spring element in the direction of the axis of the balance staff, so that the bearing ring with the bearing elements bears with spring tension against a staff end.

30. The clockwork according to claim 29, wherein the bearing ring is held axially by at least two spring elements.

31. The clockwork according to claim 22, wherein the bearing journal has the shape of a truncated cone on a journal end.

* * * * *